US012320229B1

(12) United States Patent
Dudzinski et al.

(10) Patent No.: US 12,320,229 B1
(45) Date of Patent: Jun. 3, 2025

(54) FRACKING PLUG WITH A TELESCOPIC CONE CONFIGURATION

(71) Applicant: Parker-Hannifin Corporation, Cleveland, OH (US)

(72) Inventors: Paul A. Dudzinski, Meriden, CT (US); Kenneth W. Cornett, Madison, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 18/780,620

(22) Filed: Jul. 23, 2024

Related U.S. Application Data

(60) Provisional application No. 63/600,471, filed on Nov. 17, 2023.

(51) Int. Cl.
*E21B 33/129* (2006.01)
*E21B 23/06* (2006.01)
*E21B 33/13* (2006.01)

(52) U.S. Cl.
CPC ..... *E21B 33/1293* (2013.01); *E21B 23/06* (2013.01); *E21B 33/13* (2013.01)

(58) Field of Classification Search
CPC ..... E12B 23/01; E12B 23/06; E12B 33/128; E12B 33/129; E12B 33/1291; E12B 33/1292; E12B 33/1293; E12B 33/13; E12B 33/134
See application file for complete search history.

(56) References Cited

U.S. PATENT DOCUMENTS 63,747 A * 4/1867 Petty et al. ..... E21B 33/128 277/944
2,076,314 A * 4/1937 Zschokke ..... E21B 23/06 166/134
2,230,712 A * 2/1941 Bendeler ..... E21B 33/128 166/134
2,780,294 A * 2/1957 Loomis ..... E21B 33/1216 277/339
8,403,036 B2 3/2013 Neer et al.
9,574,415 B2 * 2/2017 Xu ..... E21B 33/12
(Continued)

FOREIGN PATENT DOCUMENTS

CN 108412475 A * 8/2018 ..... E21B 33/134
CN 110005369 A * 7/2019
(Continued)

*Primary Examiner* — Jennifer H Gay
(74) *Attorney, Agent, or Firm* — McDonnell Boehnen Hulbert & Berghoff LLP

(57) ABSTRACT

An example plug assembly includes: a telescopic cone comprising a sealing cone and an anchoring cone, wherein the sealing cone and the anchoring cone are configured to move together in a distal direction, while the sealing cone is allowed to move relative to the anchoring cone in a proximal direction; a seal mounted to the sealing cone; and an anchoring ring mounted to the anchoring cone and comprising a plurality of segments disposed in a circular array, wherein during deployment of the plug assembly, the telescopic cone is driven in the distal direction, thereby expanding the anchoring ring and the seal, and wherein as the seal is allowed to relax after deployment, the seal pulls the sealing cone away from the anchoring cone, which remains in position relative to the anchoring ring.

20 Claims, 5 Drawing Sheets

(56) References Cited

U.S. PATENT DOCUMENTS

| | | | | |
|---|---|---|---|---|
| 10,066,453 | B2 * | 9/2018 | Silva | E21B 33/134 |
| 10,337,279 | B2 | 7/2019 | Frazier | |
| 10,533,392 | B2 * | 1/2020 | Walton | E21B 23/06 |
| 10,538,988 | B2 * | 1/2020 | Pabon | E21B 33/128 |
| 11,319,770 | B2 * | 5/2022 | Reyes Villegas | E21B 23/01 |
| 11,408,245 | B2 * | 8/2022 | Dudzinski | E21B 33/128 |
| 11,499,390 | B2 * | 11/2022 | Chen | E21B 33/128 |
| 11,732,546 | B1 * | 8/2023 | Qiu | E21B 33/1208 166/387 |
| 12,139,994 | B2 * | 11/2024 | Yuan | E21B 33/128 |
| 2015/0129215 | A1 * | 5/2015 | Xu | C22C 1/0408 166/285 |
| 2017/0044859 | A1 | 2/2017 | Blair | |
| 2017/0145781 | A1 * | 5/2017 | Silva | E21B 23/06 |
| 2017/0342795 | A1 * | 11/2017 | Pabon | E21B 23/01 |
| 2018/0038193 | A1 * | 2/2018 | Walton | E21B 23/06 |
| 2018/0171746 | A1 * | 6/2018 | Dudzinski | E21B 33/134 |
| 2020/0370392 | A1 | 11/2020 | Jordan, Jr. et al. | |
| 2021/0404285 | A1 * | 12/2021 | Reyes Villegas | E21B 33/1292 |
| 2022/0195830 | A1 * | 6/2022 | Chen | E21B 33/128 |
| 2023/0203912 | A1 | 6/2023 | Zhong et al. | |
| 2024/0287867 | A1 * | 8/2024 | Patsy | E21B 33/128 |
| 2024/0287869 | A1 * | 8/2024 | Yuan | E21B 33/128 |

FOREIGN PATENT DOCUMENTS

| | | | | |
|---|---|---|---|---|
| CN | 111677477 | A * | 9/2020 | |
| CN | 211448603 | U * | 9/2020 | E21B 33/1212 |
| CN | 111878032 | A * | 11/2020 | |
| CN | 112901113 | A * | 6/2021 | |
| CN | 114809976 | A * | 7/2022 | |
| CN | 114856520 | A * | 8/2022 | E21B 33/129 |
| CN | 114876407 | A * | 8/2022 | |
| CN | 116146146 | A * | 5/2023 | |
| CN | 116752932 | A * | 9/2023 | E21B 33/134 |
| CN | 114809981 | B * | 3/2024 | E21B 23/01 |
| CN | 117646613 | A * | 3/2024 | |
| CN | 117846539 | A * | 4/2024 | |

* cited by examiner

FRACKING PLUG WITH A TELESCOPIC CONE CONFIGURATION

CROSS REFERENCE TO RELATED APPLICATION

The present application claims priority to U.S. Provisional Application No. 63/600,471 filed on Nov. 17, 2023, the entire contents of which are herein incorporated by reference as if fully set forth in this description.

BACKGROUND

Fracking is a well stimulation technique that involves the fracturing of formations in bedrock by a pressurized liquid. The process involves the high-pressure injection of "fracking fluid" into a wellbore to create cracks in the deep-rock formations through which natural gas, petroleum, and brine can flow more freely.

In fracking applications, a plug can be used to seal and isolate certain portions of a drilled well from other portions of the well. A sealing plug that fully isolates one well portion (e.g., a downstream or down hole portion) from another well portion (e.g., an upstream or up hole portion), wholly blocking flow between the two portions, can be referred to as a bridge plug. Other types of plugs may allow flow in a particular direction (e.g., downstream), but block flow in other directions (e.g., upstream). Plug seals may be permanent, or may be nonpermanent dissolving or otherwise removable plugs.

For example, a bridge plug may be located within a well casing to isolate a downstream portion of a well from an upstream portion of the well. In the upstream portion, the well casing may include a plurality of transverse holes that open into a surrounding rock formation. In the hydraulic fracturing process, pressurized fluid is pumped down into the well. At the bridge plug, flow of such fluid is blocked from proceeding from the upstream portion to the downstream portion, thereby causing the upstream portion of the well to be pressurized the well. Under such pressure, the fluid is forced through holes in the upstream well casing into the adjacent rock formation. The pressurized flow into the rock formation in turn creates cracks through which oil and gas may be extracted.

The plug is typically anchored in place via a particular component. A setting tool is attached to the plug, and then both the tool and the plug are driven to a particular desired position within the well casing. The plug is then anchored in position to the well casing or pipe. When the tool is withdrawn and is separated from the plug, components of the plug may relax or become unloaded. In conventional plugs, such unloading or relaxation of the component may cause the anchoring component to at least partially disengage from the well casing. Under high pressure from fluid, the anchoring component may thus be dislodged, leading to loss of anchoring and failure of the plug.

It may thus be desirable to configure the plug in a manner that reduces or eliminates the likelihood of loss of anchoring of the plug. It is with respect to these and other considerations that the disclosure made herein is presented.

SUMMARY

The present disclosure describes implementations that relate to a fracking plug with a telescopic cone configuration.

In a first example implementation, this disclosure describes a plug assembly including: a telescopic cone comprising a sealing cone and an anchoring cone, wherein the sealing cone and the anchoring cone are configured to move together in a distal direction, while the sealing cone is allowed to move relative to the anchoring cone in a proximal direction; a seal mounted to the sealing cone; and an anchoring ring mounted to the anchoring cone and comprising a plurality of segments disposed in a circular array, wherein during deployment of the plug assembly, the telescopic cone is driven in the distal direction, thereby expanding the anchoring ring and the seal, and wherein as the seal is allowed to relax after deployment, the seal pulls the sealing cone away from the anchoring cone, which remains in position relative to the anchoring ring.

In a second example implementation, this disclosure describes a method of deploying the plug assembly of the first example implementation in a tube.

In a third example implementation, this disclosure describes a system including a tube, the plug assembly of the first example implementation, and a tool for deploying the plug assembly into the tube.

The foregoing summary is illustrative only and is not intended to be in any way limiting. In addition to the illustrative aspects, implementations, and features described above, further aspects, implementations, and features will become apparent by reference to the figures and the following detailed description.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

In examples, a fracking plug needs to be anchored firmly in place within well casing (steel tubing) and needs to seal fluid under pressures that can exceed 10,000 pounds per square inch (psi) to effectively isolate one section of a well casing from another. Within examples, the anchoring function and the sealing function are both activated by expanding over a cone using a hydraulic setting tool that is capable of generating many tons of force.

An elastomeric ring-shaped seal is expanded over the cone during deployment of the plug. The seal exhibits some distortion during expansion, and such distortion rolls the seal surface that is in contact with the cone in the direction that the cone is moving in during deployment.

The anchoring function can be provided by a segmented anchoring ring, and the segments of such anchoring ring are expanded radially outward by (e.g., driven up) the cone in unison with the seal. The segments come into contact with the well casing and drive hard anchoring features (e.g., teeth with sharp edges) into the casing creating depressions. It is desirable for the segments to remain engaged with the well casing depressions to firmly hold position. This way, the segments remain locked to the casing, and support is provided through the shear resistance of the high strength casing steel and not just through surface friction between the segments and well casing.

When the hydraulic setting tool is withdrawn and separated from the plug, the seal distortion is allowed to relax. The seal is mounted to the cone, so this distortion release can pull the cone back and away from the segments, unloading the segments. As such, this unloading of the segments may cause the segments to disengage from the well casing, leading to a loss of anchoring and plug failure.

Disclosed herein are systems, assemblies, and methods associated with a plug assembly having a two-piece, telescopic cone construction. The term telescopic is used herein to generally indicate that the cone has concentric tubular sections configured to slide relative to each other, at least in one direction. This two-piece construction of the cone separates the anchoring function from the sealing function of the cone. Particularly, the telescopic cone has a sealing cone portion that is allowed to move relative an anchoring cone portion. This way, the anchoring cone portion remains in position applying a radially-outward force on the segments of the anchoring ring, while the sealing cone portion is allowed to be pulled back via the seal when the tool is withdrawn. With this configuration, the segments of the anchoring ring are prevented from disengaging from the well casing.

Figure 1:
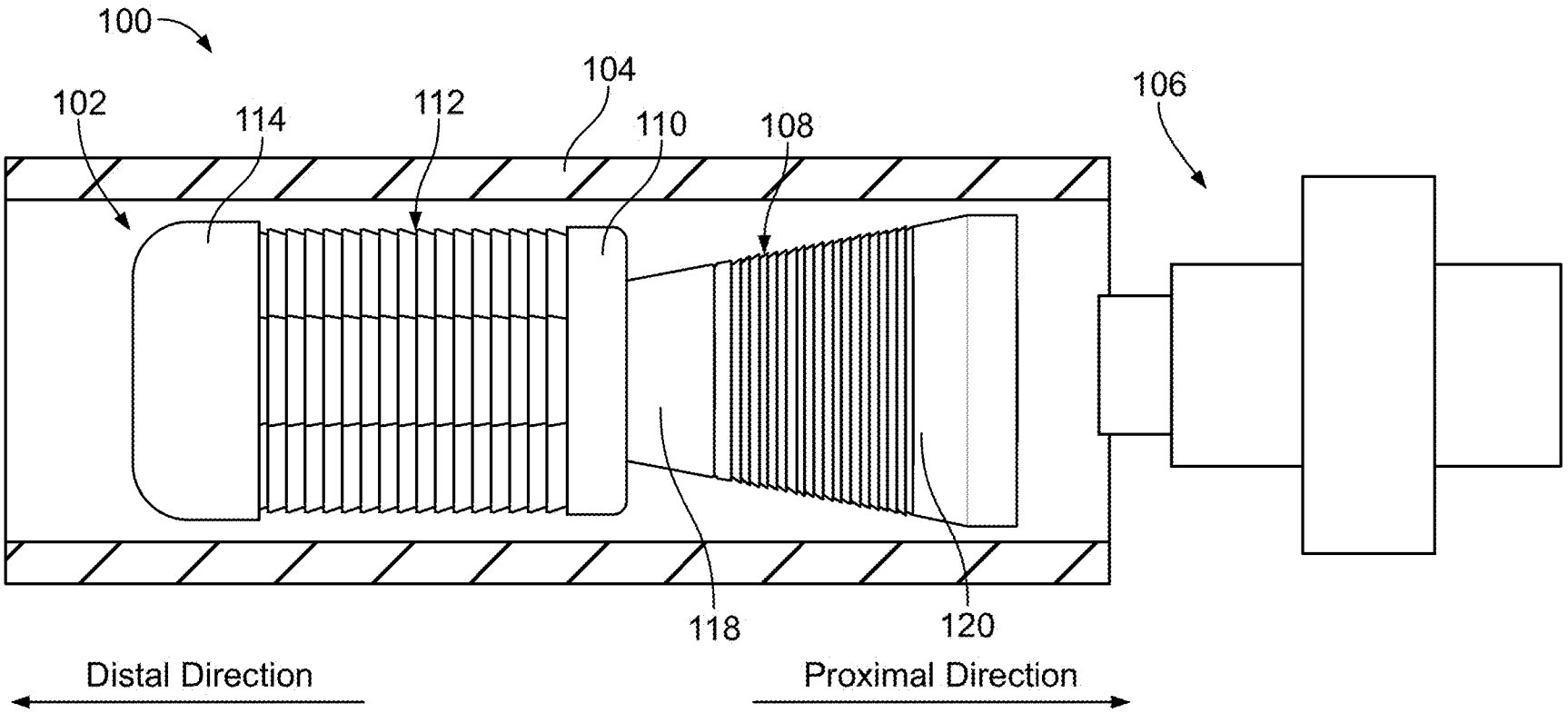
FIG. 1 illustrates a system having a plug assembly disposed within a tube via a tool, according to an example implementation.
Figure 2:
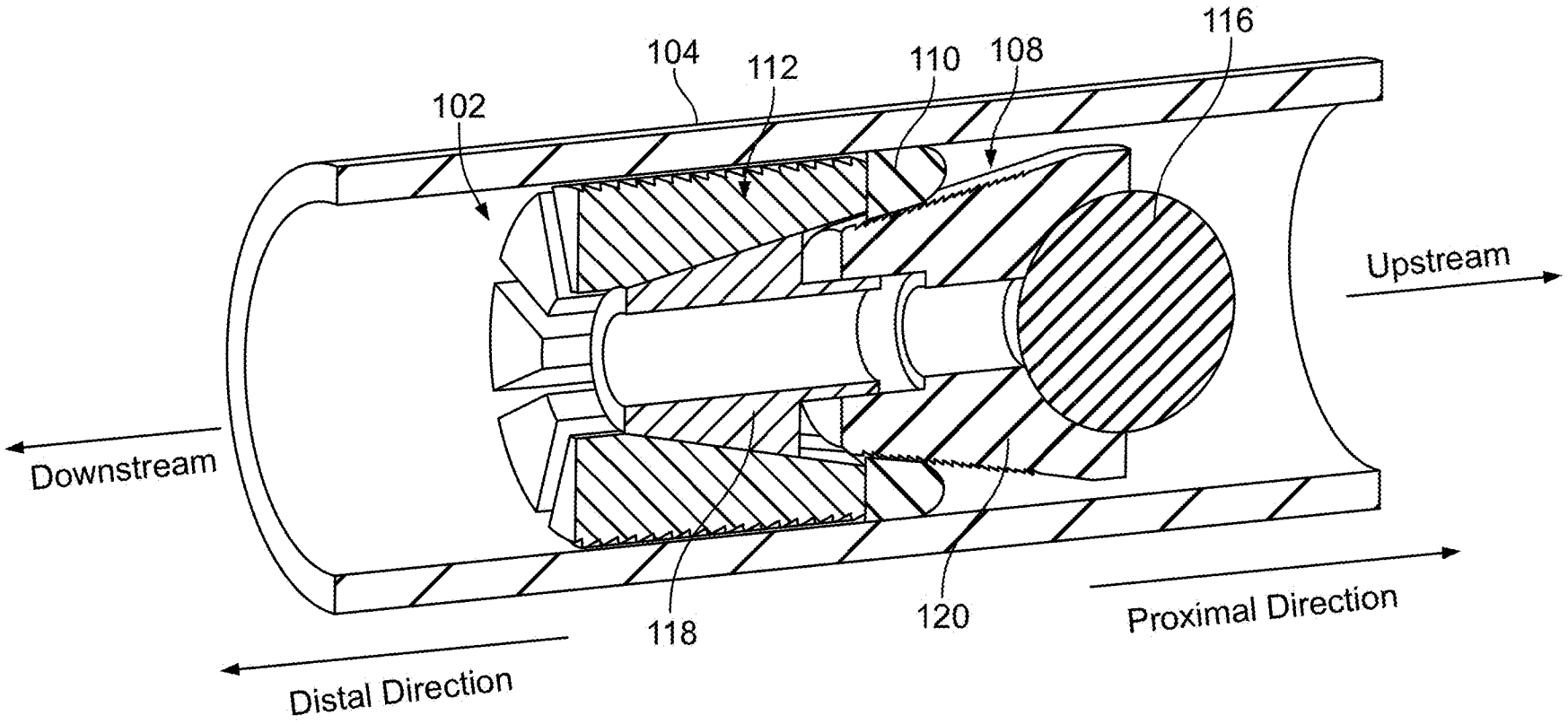
FIG. 2 illustrates a perspective cross-sectional view of the plug assembly positioned within the tube of FIG. 1, according to an example implementation.

FIG. 1 illustrates a system 100 having a plug assembly 102 disposed within a tube 104 via a tool 106, and FIG. 2 illustrates a perspective cross-sectional view of the plug assembly 102 positioned within the tube 104, according to an example implementation. The tube 104 represents a well casing in a fracking application and can be made of high strength steel, for example. The tool 106 can be a hydraulic setting tool that is attached to the plug assembly 102, and then both the tool 106 and the plug assembly 102 are pushed (e.g., via water or any fluid) down the tube 104 to a particular position within the tube 104. The tool 106 is depicted in a simplified manner in FIG. 1 and is shown as being separate from the plug assembly 102. However, it should be understood that during conveyance of the plug assembly 102 to a particular location within the tube 104, the tool 106 is attached to the plug assembly 102. After activation and anchoring of the plug assembly 102 to the tube 104 at the particular location, the tool 106 is decoupled (e.g., via shear features) and is pulled away from the plug assembly 102.

The plug assembly 102 includes a telescopic cone 108, a seal 110, an anchoring ring 112, and an end plate 114. As shown in FIG. 2, the anchoring ring 112 is segmented, and the end plate 114 keeps the segments together during deployment of the plug assembly 102. The end plate 114 can be bonded (e.g., via an adhesive) to the anchoring ring 112, for example. Prior to deployment, the outer diameter of the anchoring ring 112 is smaller than an inner diameter of the tube 104.

To deploy the plug assembly 102 within the tube 104, the tool 106 and the plug assembly 102 are driven down the tube 104 until the plug assembly 102 reaches a desired position. The tool 106 is then used to apply a large force (e.g., up to 20,000 pound-force) to insert the telescopic cone 108 into the seal 110 and the anchoring ring 112 (which is segmented as shown in FIG. 2), causing them to expand against an interior peripheral surface of the tube 104. Under such force and expansion of the anchoring ring 112, the end plate 114 can shear off, leaving the anchoring ring 112 in position.

A ball 116 shown in FIG. 2 can then be dropped into the tube 104 to seal the telescopic cone 108 and prevent fluid flow through the telescopic cone 108 (which is hollow). The seal 110 is configured to seal against the interior peripheral surface of the tube 104. With this configuration, the plug assembly 102 seals or isolates a upstream portion (proximal direction) of the tube 104 having high pressure fluid from a downstream portion (distal direction) of the tube 104.

Reference to "distal" and "proximal" herein is not intended to imply a specific orientation of components of the plug assembly 102 relative to any surrounding environment. Instead, these directional terms are intended to facilitate a description of the interrelationship between the several components of the plug assembly 102 and their function.

The telescopic cone 108 has a two-piece construction. Particularly, the telescopic cone 108 has an anchoring cone 118 and a sealing cone 120, and the anchoring cone 118 is disposed distally from the sealing cone 120. The telescopic cone 108 is referred to as being telescopic as the sealing cone 120 is allowed to move relative to the anchoring cone 118 in the proximal direction as described in more detail below.

Figure 3B:
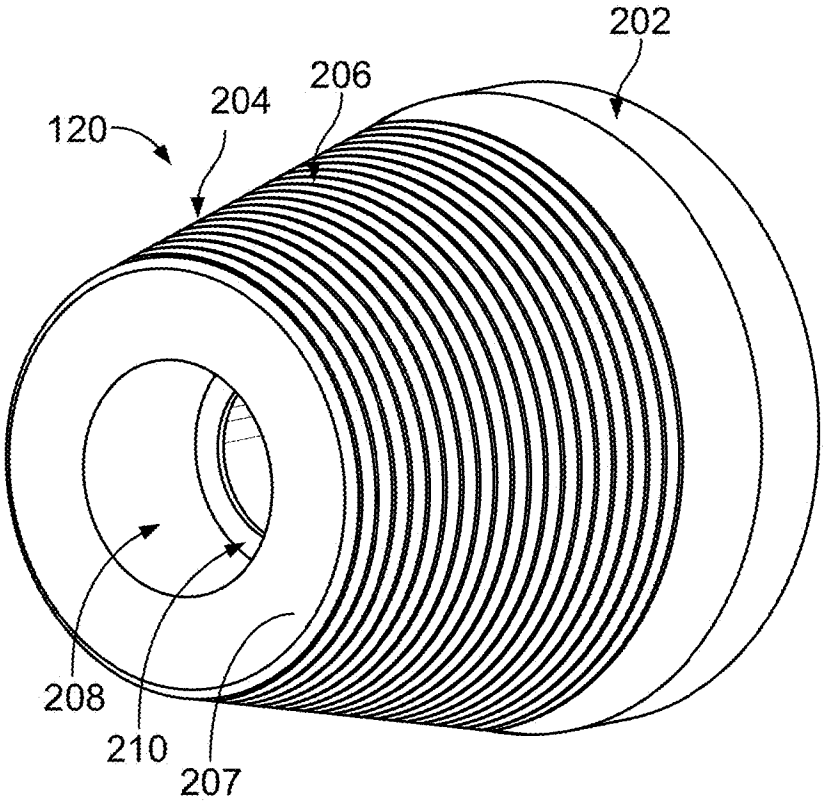
FIG. 3B illustrates another perspective view of the sealing cone of FIG. 3A from a different angle, according to an example implementation.
Figure 3A:
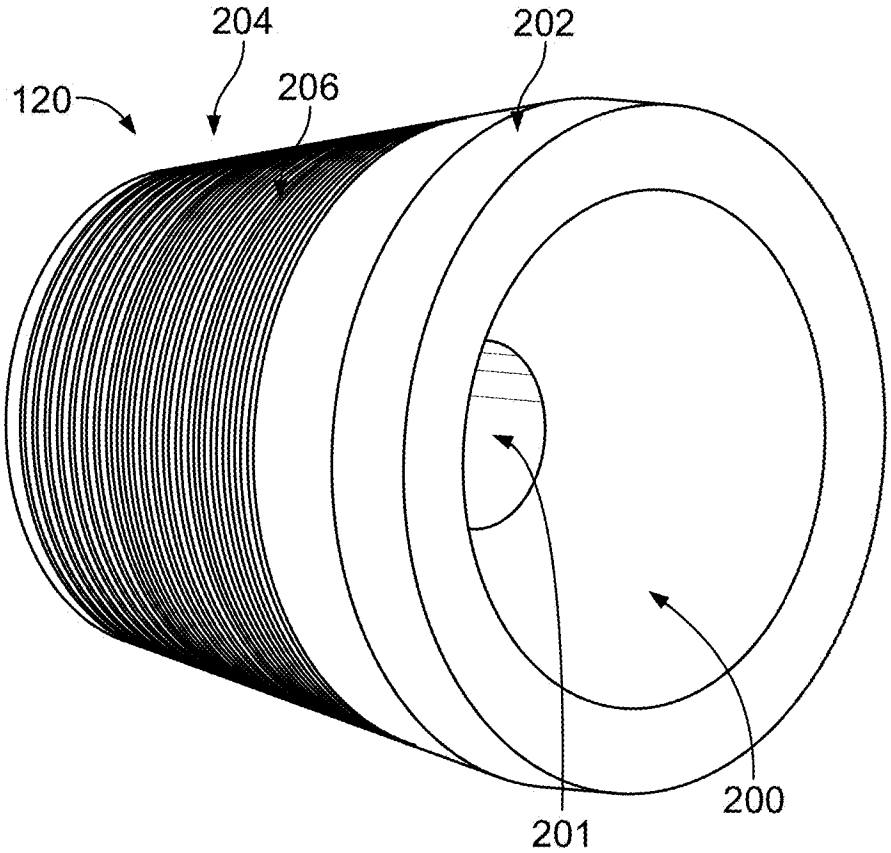
FIG. 3A illustrates a perspective view of a sealing cone, according to an example implementation.

FIG. 3A illustrates a perspective view of the sealing cone 120, and FIG. 3B illustrates another perspective view of the sealing cone 120 from a different angle, according to an example implementation. The sealing cone 120 has a ball seat 200 formed at a proximal end of the sealing cone 120. The ball seat 200 is configured to receive the ball 116 as shown in FIG. 2 to seal an internal channel 201 formed in the sealing cone 120.

As depicted, the sealing cone 120 can have a proximal portion 202 with a smooth surface, and a distal portion 204 having seal gripping feature 206 (e.g., saw tooth features) that facilitates gripping an interior peripheral surface of the seal 110. Particularly, friction between the interior peripheral surface of the seal 110 and the seal gripping feature 206 facilitates securely mounting the seal 110 to the sealing cone 120. This way, as the sealing cone 120 is driven in the distal direction, the interior peripheral surface of the seal 110 in contact with the sealing cone 120 is distorted and rolled up.

As shown in FIG. 3B, the distal portion 204 has a distal end face 207 and has a counterbore 208 (e.g., tubular portion) formed therein. The counterbore 208 defines a shoulder 210 as shown. The anchoring cone 118 has a corresponding tubular or cylindrical portion that is configured to be inserted into the counterbore 208 of the sealing cone 120.

Figure 4:
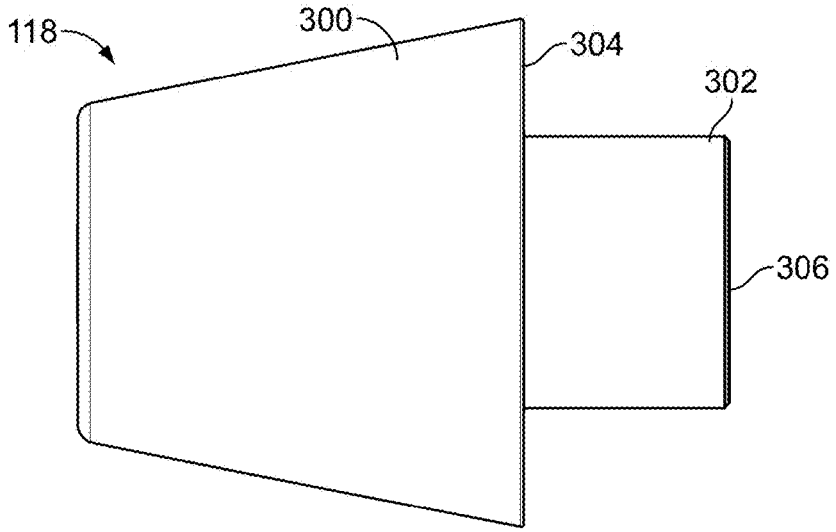
FIG. 4 illustrates a side view of an anchoring cone, according to an example implementation.

FIG. 4 illustrates a side view of the anchoring cone 118, according to an example implementation. The anchoring cone 118 has a tapered distal portion 300 and a cylindrical proximal portion 302. A shoulder 304 is formed at the transition between the tapered distal portion 300 and the cylindrical proximal portion 302. The cylindrical proximal portion 302 has a proximal end face 306 that is flat.

The cylindrical proximal portion 302 is inserted into or received within the counterbore 208 of the sealing cone 120. With this configuration, the anchoring cone 118 is configured to be inserted partially within the counterbore 208, and is slidably accommodated within the sealing cone 120.

When the plug assembly 102 is being deployed (e.g., being pushed along with the tool 106 via fluid within the tube 104 in the distal direction), the distal end face 207 of the sealing cone 120 interfaces with the shoulder 304 of the anchoring cone 118 and/or the proximal end face 306 of the anchoring cone 118 interfaces with the shoulder 210 within the sealing cone 120. This way, as the tool 106 pushes the telescopic cone 108 in the distal direction, the anchoring cone 118 and the sealing cone 120 move in unison as one component in the distal direction during the setting or activation of the plug assembly 102.

As mentioned above, the anchoring ring 112 is segmented. Particularly, the anchoring ring 112 includes a plurality of segments disposed in a circular array.

Figure 5A:
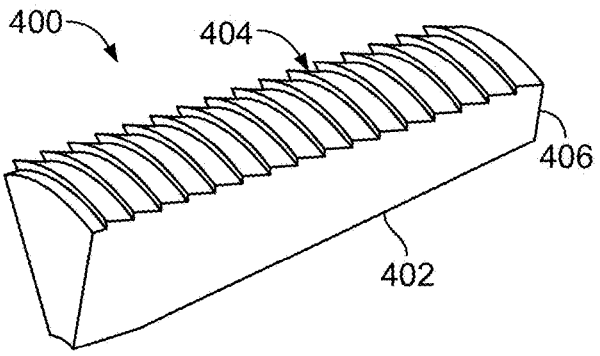
FIG. 5A illustrates a perspective top view of a segment of a plurality of segments of an anchoring ring, according to an example implementation.
Figure 5B:
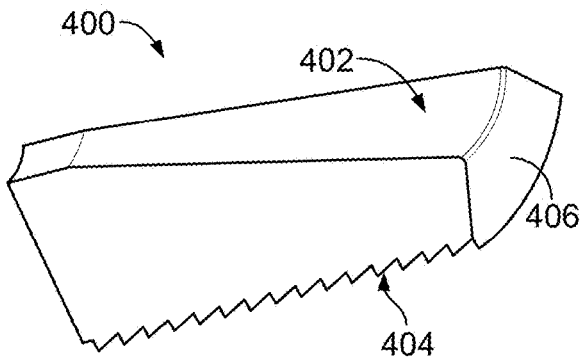
FIG. 5B illustrates a perspective bottom view of the segment of FIG. 5A, according to an example implementation illustrates.

FIG. 5A illustrates a perspective top view of a segment 400 of a plurality of segments of the anchoring ring 112, and FIG. 5B illustrates a perspective bottom view of the segment 400, according to an example implementation. The segment 400 (and the other segments of the anchoring ring 112) has a tapered interior surface 402 that interfaces with the tapered distal portion 300 of the anchoring cone 118. This way, as the anchoring cone 118 is driven into the anchoring ring 112, the anchoring ring 112 expands. As such, longitudinal or axial movement of the anchoring cone 118 in the distal direction, causes the segments to separate from each other and move radially outward, toward the interior peripheral surface of the tube 104.

The segment 400 includes one or more anchoring feature(s) 404 disposed on its exterior surface that facilitate affixing the segment 400 of the anchoring ring 112 to the tube 104. The anchoring feature(s) 404 can be teeth, serrations, barbs, wickers, buttons, or posts as examples. For example, as depicted in FIGS. 5A-5B, the anchoring feature(s) 404 can include teeth with sharp edges that are driven into the interior surface of the tube 104, creating depressions in the tube 104, as the anchoring ring 112 expands (due to distal movement of the anchoring cone 118 within, and its interaction with, the tapered surfaces of the segments). This way the anchoring ring 112 remains locked to the tube 104 and support is provided through the shear resistance of the high strength steel of the tube 104, and not just through surface friction between the segments (e.g., the segment 400) and the tube 104. As such, the anchoring ring 112 can also be referred to as a slip ring or slip-prevention ring, and the individual segments can be referred to as the slips.

It is desirable for the segments to remain engaged with the tube 104 and not be dislodged under high pressure fluid forces. The two-piece construction of the telescopic cone 108 enables the anchoring ring 112 to remain engaged with the tube 104 when the tool 106 is withdrawn after deployment as described in more detail below.

The seal 110 is mounted to the distal portion 204 of the sealing cone 120 and interfaces with a proximal end of the anchoring ring 112. For example, the seal 110 interfaces with a proximal end face 406 of the segment 400.

Figure 6:
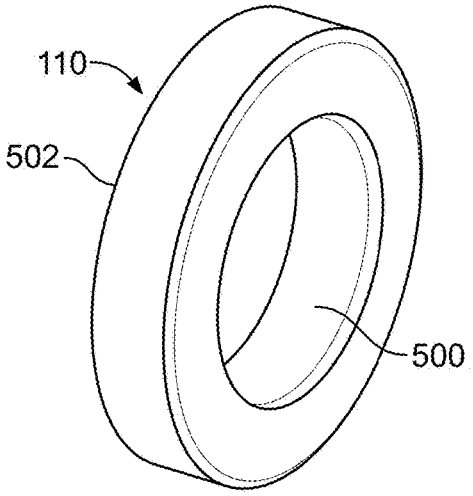
FIG. 6 illustrates a perspective view of a seal, according to an example implementation.

FIG. 6 illustrates a perspective view of the seal 110, according to an example implementation. The seal 110 can be configured as a radial seal made of an elastomeric material, for example. The seal 110 is ring shaped as depicted and has an interior peripheral surface 500 that interfaces with the seal gripping feature 206 of the sealing cone 120. The seal 110 also has a distal end face 502 that interfaces with the proximal end face of the segments (e.g., the proximal end face 406 of the segment 400) of the anchoring ring 112.

As mentioned above, the tool 106 is used to activate the plug assembly 102 and anchor it in a sealing position within the tube 104 once the plug assembly 102 and the tool 106 reach a particular desired location within the tube 104. In an example, the tool 106 can have a rod that passes through the plug assembly 102 and is attached to the end plate 114 via a decoupling feature (e.g., a shear feature). In this example, the plug assembly 102 can be referred to as having a "bottom set" configuration due to the decoupling feature being oriented on the downstream or distal end of the plug assembly 102. The tool 106 can also have a setting collar. To activate the plug assembly 102 once it reaches the desired location, the rod of the tool 106 holds the end plate 114 in position while the setting collar pushes on the telescopic cone 108 to move in the distal direction. This puts the rod in tension. As such, the sealing cone 120 along with the anchoring cone 118 are pushed in the distal direction into the seal 110 and the segments of the anchoring ring 112. The tapered surface of the tapered distal portion 300 of the anchoring cone interacts with the tapered surfaces (e.g., the tapered interior surface 402) of the segments of the anchoring ring 112, causing the anchoring ring 112 to expand, contacting the interior peripheral surface of the tube 104 to be anchored thereto (e.g., via the anchoring feature(s) 404).

Also, the distal portion 204 (which is tapered) of the sealing cone 120 interacts with the interior peripheral surface 500 of the seal 110 as the telescopic cone 108 is being driven by the tool 106 in the distal direction, causing the seal 110 to expand and seal against the interior peripheral surface of the tube 104. As the seal 110 expands, it exhibits some distortion. Particularly, the interior peripheral surface 500, which is in contact with the sealing cone 120, is rolled in the distal direction (e.g., the direction in which the telescopic cone 108 moves during deployment).

As mentioned above, the rod of the tool 106 is put in tension while activating the plug assembly 102. This allows the rod to decouple from the end plate 114 when an appropriate shear load is generated, thereby allowing the tool 106 to decouple from the plug assembly 102. When the tool 106 is decoupled from the plug assembly 102, separating from the telescopic cone 108, the distortion of the seal 110 is allowed to relax. The grip between the interior peripheral surface 500 of the seal 110 and the seal gripping feature 206 of the sealing cone 120 prevents the seal 110 from sliding down the interior peripheral surface 500 of the seal 110 when the tool 106 is withdrawn. However, the distortion release pulls the sealing cone 120 back slightly in the proximal direction and away from the anchoring ring 112.

Advantageously, however, the configuration of the telescopic cone 108 allows the sealing cone 120 to be pulled back in the proximal direction, while the anchoring cone 118 remains in position. Particularly, as shown in FIG. 2, the sealing cone 120 is allowed to slide in the proximal direction relative to the anchoring cone 118, which remains in position applying a radially-outward force on the anchoring ring 112 to keep it engaged with the tube 104.

In an example, the sealing cone 120 can slide a distance in the range of 0.1-0.25 inches in the proximal direction upon withdrawal of the tool 106. Also, in an example, the sealing cone 120 remains overlapped with the cylindrical proximal portion 302 of the anchoring cone 118 after the sealing cone 120 moves in the proximal direction (see FIG. 2). In other words, the sealing cone 120 might not be completely separated from the anchoring cone 118.

As mentioned above, the sealing cone 120 has the seal gripping feature 206 that grips the interior peripheral surface 500 of the seal 110 so they remain in a sealing configuration as the sealing cone 120 moves in the proximal direction. Also, in an example, the anchoring cone 118 can be locked to the anchoring ring 112 to ensure that they remain engaged while the sealing cone 120 is pulled in the proximal direction via the seal 110. Such locking can be accomplished in various ways. For example, surface friction between the anchoring cone 118 and segments of the anchoring ring 112 might be sufficient. In another example, a pressure sensitive adhesive can be used, where pressure between the anchoring cone 118 and the anchoring ring 112 during deployment activates such adhesive, causing the anchoring cone 118 to be coupled or adhered to the segments of the anchoring ring. In one example, a ratchet mechanism can be used between the segments of the anchoring ring 112 and the anchoring cone 118.

As such, the two-piece construction of the telescopic cone 108 isolates the anchoring function from the sealing function. While the two components, the anchoring cone 118 and the sealing cone 120 remain abutted, engaged, and aligned while moving in the distal direction during deployment of the plug assembly 102, the sealing cone is allowed to slide relative to the anchoring cone 118 in the proximal direction. This allows the sealing cone 120 to move slightly in the proximal direction as the seal 110 relaxes when the tool 106 is removed, while allowing the anchoring cone 118 to remain firmly in position, keeping the anchoring ring 112 engaged with the tube 104.

In this manner, the likelihood of the anchoring feature(s) 404 of the segments (e.g., the segment 400) of the anchoring ring 112 disengaging from the interior surface of the tube 104 is reduced or eliminated. As such, the likelihood of a loss of anchoring resulting in plug failure is also reduced or eliminated.

Figure 7:
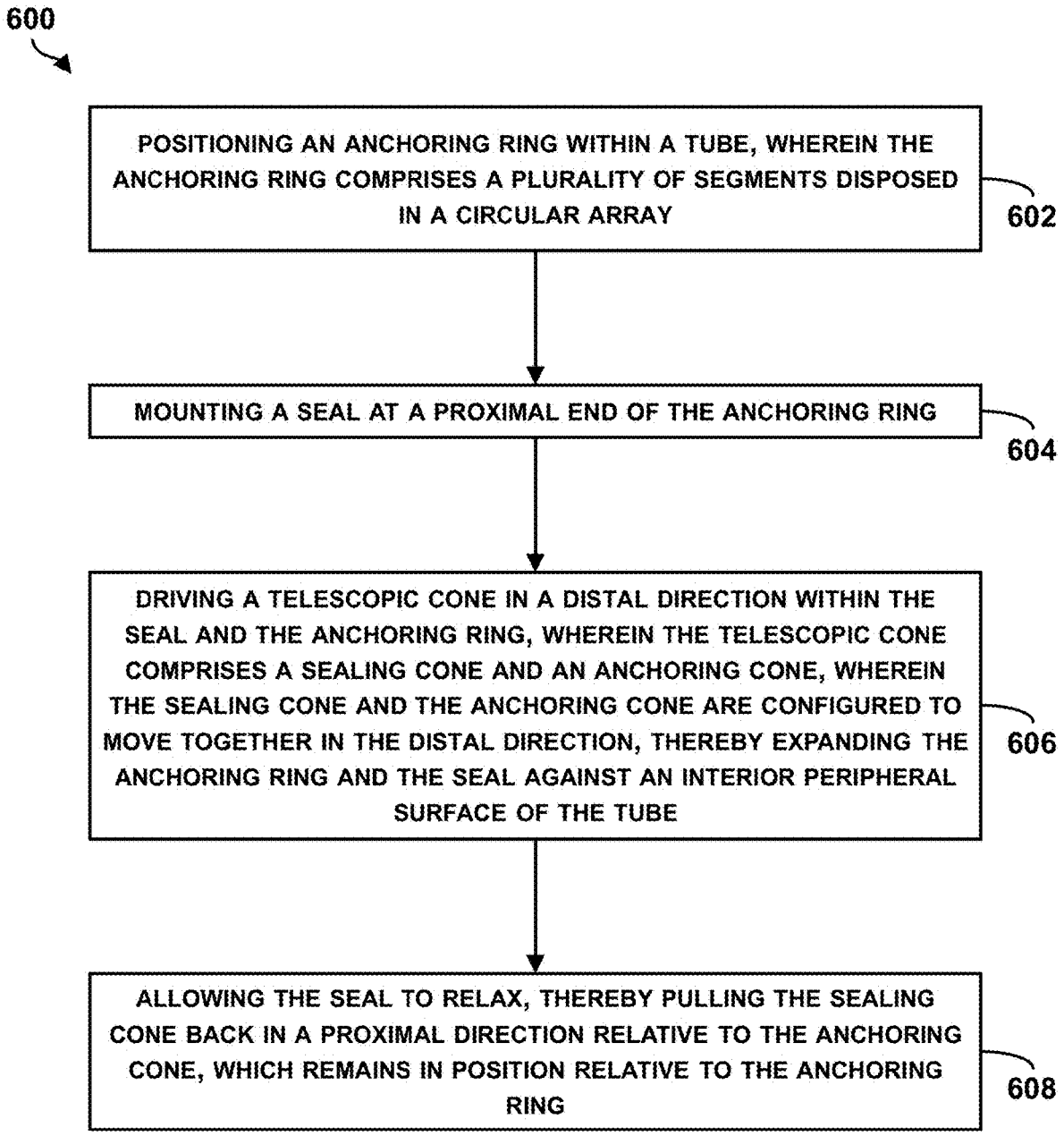
FIG. 7 is a flowchart of a method for deploying a plug assembly in a tube, according to an example implementation.

FIG. 7 is a flowchart of a method 600 for deploying the plug assembly 102 in the tube 104, according to an example implementation. The method 600 may include one or more operations, functions, or actions as illustrated by one or more of blocks 602-608. Although the blocks are illustrated in a sequential order, these blocks may also be performed in parallel, and/or in a different order than those described herein. Also, the various blocks may be combined into fewer blocks, divided into additional blocks, and/or removed based upon the desired implementation. It should be understood that for this and other processes and methods disclosed herein, flowcharts show functionality and operation of one possible implementation of present examples. Alternative implementations are included within the scope of the examples of the present disclosure in which functions may be executed out of order from that shown or discussed, including substantially concurrent or in reverse order, depending on the functionality involved, as would be understood by those reasonably skilled in the art.

At block 602, the method 600 includes positioning the anchoring ring 112 within the tube 104, wherein the anchoring ring 112 comprises a plurality of segments (e.g., the segment 400) disposed in a circular array.

At block 604, the method 600 includes mounting the seal 110 at a proximal end of the anchoring ring 112.

At block 606, the method 600 includes driving the telescopic cone 108 in a distal direction within the seal 110 and the anchoring ring 112, wherein the telescopic cone 108 comprises the sealing cone 120 and the anchoring cone 118, wherein the sealing cone 120 and the anchoring cone 118 are configured to move together in the distal direction, thereby expanding the anchoring ring 112 and the seal 110 against an interior peripheral surface of the tube 104.

At block 608, the method 600 includes allowing the seal 110 to relax, thereby pulling the sealing cone 120 back in a proximal direction relative to the anchoring cone 118, which remains in position relative to the anchoring ring 112.

The method 600 can further include any of the other steps or operations described throughout herein.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. Thus, the figures should be generally viewed as component aspects of one or more overall implementations, with the understanding that not all illustrated features are necessary for each implementation.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" or "about" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide.

The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

Embodiments of the present disclosure can thus relate to one of the enumerated example embodiments (EEEs) listed below.

EEE 1 is a plug assembly comprising: a telescopic cone comprising a sealing cone and an anchoring cone, wherein the sealing cone and the anchoring cone are configured to move together in a distal direction, while the sealing cone is allowed to move relative to the anchoring cone in a proximal direction; a seal mounted to the sealing cone; and an anchoring ring mounted to the anchoring cone and comprising a plurality of segments disposed in a circular array, wherein during deployment of the plug assembly, the telescopic cone is driven in the distal direction, thereby expanding the anchoring ring and the seal, and wherein as the seal is allowed to relax after deployment, the seal pulls the sealing cone away from the anchoring cone, which remains in position relative to the anchoring ring.

EEE 2 is the plug assembly of EEE 1, wherein the anchoring cone has a cylindrical proximal portion, and wherein the sealing cone has a counterbore that receives the cylindrical proximal portion of the anchoring cone, thereby allowing the sealing cone to slide about the cylindrical proximal portion of the anchoring cone in the proximal direction.

EEE 3 is the plug assembly of EEE 2, wherein the anchoring cone further comprises a tapered distal portion configured to interact with respective tapered interior surfaces of respective segments of the anchoring ring, thereby causing the anchoring ring to expand upon axial movement of the anchoring cone in the distal direction.

EEE 4 is the plug assembly of EEE 3, wherein the anchoring cone comprises a shoulder formed at a transition between the tapered distal portion and the cylindrical proximal portion, wherein the shoulder is configured to contact a distal end face of the sealing cone to allow the sealing cone and the anchoring cone to move together in the distal direction.

EEE 5 is the plug assembly of any of EEEs 1-4, wherein the sealing cone comprises seal gripping feature formed in an exterior surface of the sealing cone and interfacing with an interior peripheral surface of the seal, wherein the seal gripping feature allows the seal to roll up the sealing cone as the sealing cone is driven in the distal direction.

EEE 6 is the plug assembly of EEE 5, wherein the seal gripping feature comprises saw teeth.

EEE 7 is the plug assembly of any of EEEs 1-6, wherein respective segments of the anchoring ring comprises one or more anchoring features disposed on an exterior surface of the anchoring ring to facilitate affixing the anchoring ring to a tube in which the plug assembly is deployed.

EEE 8 is the plug assembly of EEE 7, wherein the one or more anchoring features comprise teeth, serrations, barbs, wickers, buttons, or posts.

EEE 9 is the plug assembly of any of EEEs 1-8, wherein the sealing cone has an internal channel and a ball seat, and wherein the plug assembly further comprises: a ball seated at the ball seat of the sealing cone to seal the internal channel of the sealing cone.

EEE 10 is the plug assembly of any of EEEs 1-9, wherein the seal interfaces with a proximal end of the anchoring ring.

EEE 11 is a method of deploying the plug assembly of any of EEEs 1-10. For example, the method comprise: positioning an anchoring ring within a tube, wherein the anchoring ring comprises a plurality of segments disposed in a circular array; mounting a seal at a proximal end of the anchoring ring; driving a telescopic cone in a distal direction within the seal and the anchoring ring, wherein the telescopic cone comprises a sealing cone and an anchoring cone, wherein the sealing cone and the anchoring cone are configured to move together in the distal direction, thereby expanding the anchoring ring and the seal against an interior peripheral surface of the tube; and allowing the seal to relax, thereby pulling the sealing cone back in a proximal direction relative to the anchoring cone, which remains in position relative to the anchoring ring.

EEE 12 is the method EEE 11, wherein the anchoring cone has a cylindrical proximal portion, and wherein the sealing cone has a counterbore that receives the cylindrical proximal portion of the anchoring cone, and wherein pulling the sealing cone back in the proximal direction relative to the anchoring cone comprises: allowing the sealing cone to slide about the cylindrical proximal portion of the anchoring cone in the proximal direction.

EEE 13 is the method of EEE 12, wherein the anchoring cone further comprises a tapered distal portion, and wherein causing the anchoring ring to expand upon axial movement of the anchoring cone in the distal direction comprises: causing the tapered distal portion of the anchoring cone to interact with respective tapered interior surfaces of respective segments of the anchoring ring, thereby pushing the respective segments radially outward.

EEE 14 is the method of EEE 13, wherein the anchoring cone comprises a shoulder formed at a transition between the tapered distal portion and the cylindrical proximal portion, and wherein driving the telescopic cone in the distal direction comprises: causing a distal end face of the sealing cone to contact the shoulder to allow the sealing cone and the anchoring cone to move together in the distal direction.

EEE 15 is the method of any of EEEs 11-14, wherein the sealing cone comprises a seal gripping feature formed in an exterior surface of the sealing cone and interfacing with an interior peripheral surface of the seal, and wherein the method further comprises: causing, via the seal gripping feature, the seal to roll up the sealing cone as the sealing cone is driven in the distal direction.

EEE 16 is the method of EEE 15, further comprising: preventing, via the seal gripping feature, the seal from sliding down an exterior surface of the sealing cone after allowing the seal to relax.

EEE 17 is the method of any of EEEs 11-16, wherein respective segments of the anchoring ring comprises one or more anchoring features disposed on an exterior surface of the anchoring ring, and wherein expanding the anchoring ring and the seal against the interior peripheral surface of the tube comprises: driving the one or more anchoring features into the tube to affix the anchoring ring to the tube.

EEE 18 is the method of any of EEEs 11-17, wherein the sealing cone has an internal channel and a ball seat, and wherein the method further comprises: mounting a ball at the ball seat of the sealing cone to seal the internal channel of the sealing cone.

EEE 19 is the method of any of EEEs 11-18, wherein driving the telescopic cone in the distal direction comprises: using a tool to drive the sealing cone along with the anchoring cone in the distal direction.

EEE 20 is the method of EEE 19, wherein allowing the seal to relax comprises: pulling the tool in the proximal direction away from the sealing cone.

What is claimed is:

1. A plug assembly comprising:

a telescopic cone comprising a sealing cone and an anchoring cone, wherein the sealing cone and the anchoring cone are configured to move together in a distal direction, while the sealing cone is allowed to move relative to the anchoring cone in a proximal direction;

a seal mounted to the sealing cone; and an anchoring ring mounted to the anchoring cone and comprising a plurality of segments disposed in a circular array, wherein during deployment of the plug assembly, the telescopic cone is driven in the distal direction, thereby expanding the anchoring ring and the seal, and wherein as the seal is allowed to relax after deployment, the seal pulls the sealing cone away from the anchoring cone, which remains in position relative to the anchoring ring.

2. The plug assembly of claim 1, wherein the anchoring cone has a cylindrical proximal portion, and wherein the sealing cone has a counterbore that receives the cylindrical proximal portion of the anchoring cone, thereby allowing the sealing cone to slide about the cylindrical proximal portion of the anchoring cone in the proximal direction.

3. The plug assembly of claim 2, wherein the anchoring cone further comprises a tapered distal portion configured to interact with respective tapered interior surfaces of respective segments of the anchoring ring, thereby causing the anchoring ring to expand upon axial movement of the anchoring cone in the distal direction.

4. The plug assembly of claim 3, wherein the anchoring cone comprises a shoulder formed at a transition between the tapered distal portion and the cylindrical proximal portion, wherein the shoulder is configured to contact a distal end face of the sealing cone to allow the sealing cone and the anchoring cone to move together in the distal direction.

5. The plug assembly of claim 1, wherein the sealing cone comprises seal gripping feature formed in an exterior surface of the sealing cone and interfacing with an interior peripheral surface of the seal, wherein the seal gripping feature allows the seal to roll up the sealing cone as the sealing cone is driven in the distal direction.

6. The plug assembly of claim 5, wherein the seal gripping feature comprises saw teeth.

7. The plug assembly of claim 1, wherein respective segments of the anchoring ring comprises one or more anchoring features disposed on an exterior surface of the anchoring ring to facilitate affixing the anchoring ring to a tube in which the plug assembly is deployed.

8. The plug assembly of claim 7, wherein the one or more anchoring features comprise teeth, serrations, barbs, wickers, buttons, or posts.

9. The plug assembly of claim 1, wherein the sealing cone has an internal channel and a ball seat, and wherein the plug assembly further comprises:

a ball seated at the ball seat of the sealing cone to seal the internal channel of the sealing cone.

10. The plug assembly of claim 1, wherein the seal interfaces with a proximal end of the anchoring ring.

11. A method comprising:

positioning an anchoring ring within a tube, wherein the anchoring ring comprises a plurality of segments disposed in a circular array;

mounting a seal at a proximal end of the anchoring ring;

driving a telescopic cone in a distal direction within the seal and the anchoring ring, wherein the telescopic cone comprises a sealing cone and an anchoring cone, wherein the sealing cone and the anchoring cone are configured to move together in the distal direction, thereby expanding the anchoring ring and the seal against an interior peripheral surface of the tube; and allowing the seal to relax, thereby pulling the sealing cone back in a proximal direction relative to the anchoring cone, which remains in position relative to the anchoring ring.

12. The method claim 11, wherein the anchoring cone has a cylindrical proximal portion, and wherein the sealing cone has a counterbore that receives the cylindrical proximal portion of the anchoring cone, and wherein pulling the sealing cone back in the proximal direction relative to the anchoring cone comprises:

allowing the sealing cone to slide about the cylindrical proximal portion of the anchoring cone in the proximal direction.

13. The method of claim 12, wherein the anchoring cone further comprises a tapered distal portion, and wherein causing the anchoring ring to expand upon axial movement of the anchoring cone in the distal direction comprises:

causing the tapered distal portion of the anchoring cone to interact with respective tapered interior surfaces of respective segments of the anchoring ring, thereby pushing the respective segments radially outward.

14. The method of claim 13, wherein the anchoring cone comprises a shoulder formed at a transition between the tapered distal portion and the cylindrical proximal portion, and wherein driving the telescopic cone in the distal direction comprises:

causing a distal end face of the sealing cone to contact the shoulder to allow the sealing cone and the anchoring cone to move together in the distal direction.

15. The method of claim 11, wherein the sealing cone comprises a seal gripping feature formed in an exterior surface of the sealing cone and interfacing with an interior peripheral surface of the seal, and wherein the method further comprises:

causing, via the seal gripping feature, the seal to roll up the sealing cone as the sealing cone is driven in the distal direction.

16. The method of claim 15, further comprising:

preventing, via the seal gripping feature, the seal from sliding down an exterior surface of the sealing cone after allowing the seal to relax.

17. The method of claim 11, wherein respective segments of the anchoring ring comprises one or more anchoring features disposed on an exterior surface of the anchoring ring, and wherein expanding the anchoring ring and the seal against the interior peripheral surface of the tube comprises:

driving the one or more anchoring features into the tube to affix the anchoring ring to the tube.

18. The method of claim 11, wherein the sealing cone has an internal channel and a ball seat, and wherein the method further comprises:

mounting a ball at the ball seat of the sealing cone to seal the internal channel of the sealing cone.

19. The method of claim 11, wherein driving the telescopic cone in the distal direction comprises:

using a tool to drive the sealing cone along with the anchoring cone in the distal direction.

20. The method of claim 19, wherein allowing the seal to relax comprises:

pulling the tool in the proximal direction away from the sealing cone.

* * * * *